United States Patent [19]

Buzzella

[11] Patent Number: 5,062,250

[45] Date of Patent: Nov. 5, 1991

[54] INSULATING PANEL SYSTEM, PANELS AND CONNECTORS THEREFOR

[75] Inventor: David Buzzella, Miami Lakes, Fla.

[73] Assignee: Metal Tech, Inc., Hialeah, Fla.

[21] Appl. No.: 485,560

[22] Filed: Feb. 27, 1990

[51] Int. Cl.[5] ..... E04C 3/28

[52] U.S. Cl. ..... 52/584; 52/464; 52/468

[58] Field of Search ..... 52/404, 461, 464, 467, 52/468, 471, 397, 580, 581, 584, 466

[56] References Cited

U.S. PATENT DOCUMENTS

| | | | |
|---|---|---|---|
| 3,527,010 | 9/1970 | Brzeyinski | 52/397 |
| 3,570,205 | 3/1971 | Payne | 52/584 X |
| 3,712,005 | 1/1973 | Eschbach | 52/210 |
| 4,635,422 | 1/1987 | Nowack | 52/406 |

FOREIGN PATENT DOCUMENTS

| | | | |
|---|---|---|---|
| 2120705 | 12/1971 | Fed. Rep. of Germany | 52/587 |

*Primary Examiner*—David A. Scherbel
*Assistant Examiner*—Kien T. Nguyen
*Attorney, Agent, or Firm*—Berman & Aisenberg

[57] ABSTRACT

An insulating panel system, for roof or wall use, includes adjacent insulating panels joined by a connector. The panels include first and second skins adjacent and in contact with opposite faces of an insulating foam core. The first and second skins each terminate in an elongated C-shaped edge. A connector for joining adjacent panels includes an elongated T-shaped channel and an elongated I-shaped channel, for receiving the C-shaped elongated edges of the first and second skins of adjacent panels, and a sheet member joining the T-shaped channel and the I-shaped channel. The foam core is cut away around the C-shaped elongated edges and the remainder of the foam core abuts the sheet member of the connector when the panels are joined. The I-shaped channel and the T-shaped channel each terminates in an elongated lip for retaining the C-shaped elongated edges of the first and second skins. Alternatively both channels may be T-shaped or both channels may be I-shaped. The panels are in snapping or sliding engagement with the connector.

19 Claims, 2 Drawing Sheets

FIG. 1
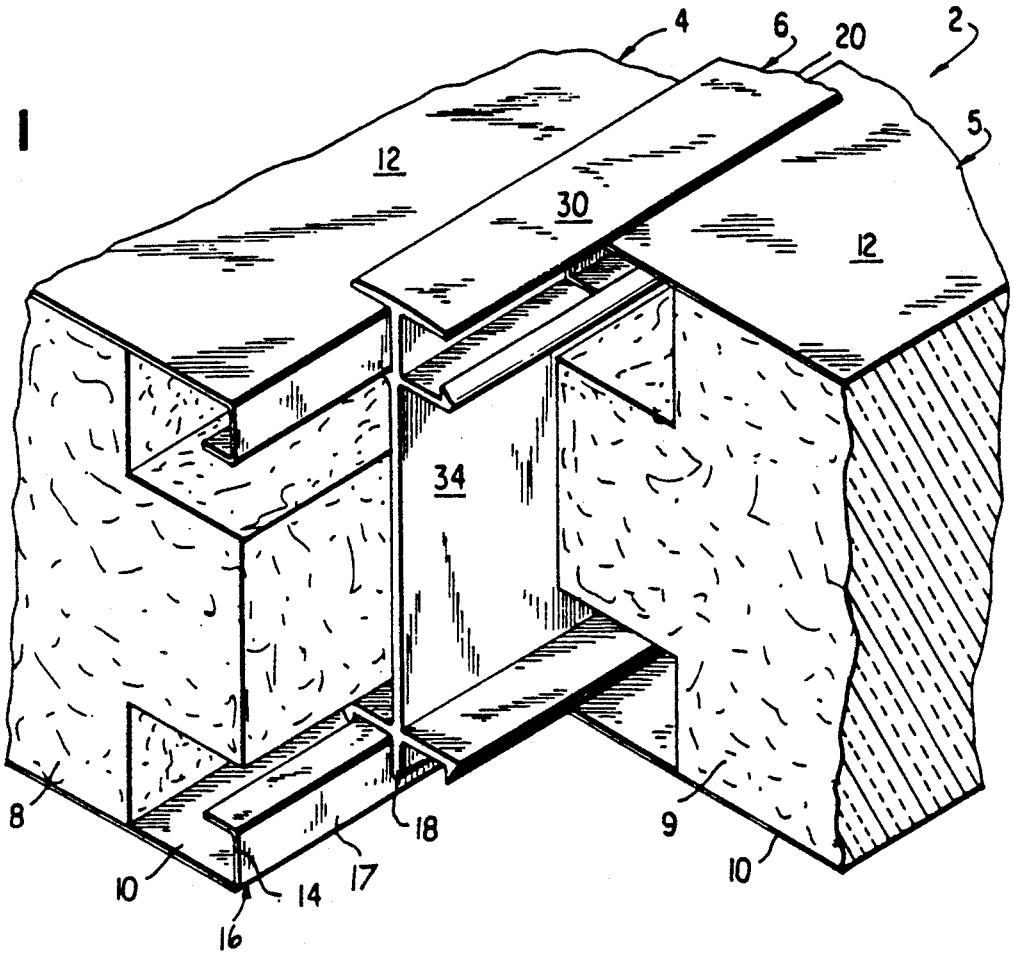
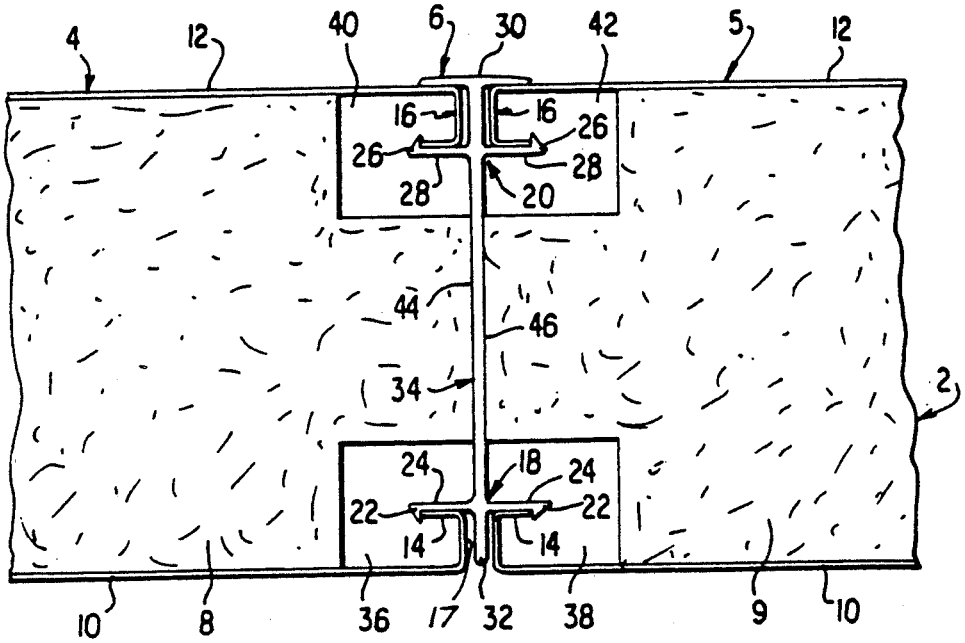
FIG. 2

INSULATING PANEL SYSTEM, PANELS AND CONNECTORS THEREFOR

FIELD OF THE INVENTION

The invention relates to a panel system for roof or wall use and panels and connectors for use in the system.

BACKGROUND OF THE INVENTION

Known insulating panel systems are complex and expensive to manufacture. Examples of known systems include that of Nowack, U.S. Pat. No. 4,635,422, which describes a system including inner and outer skins having an interlocking labyrinth seal, a central member and a separate clip. The patent to Eschbach, U.S. Pat. No. 3,712,005 describes extrusions for partitions, walls and enclosures which have straight linear ends to the inner and outer skins. Brzezinski, U.S. Pat. No. 3,527,010, describes a building wall construction used with glazing.

SUMMARY OF THE INVENTION

An insulating panel system includes adjacent insulating panels joined by a connecting member. The panels include a first skin adjacent and in contact with a first face of an insulating foam core and a second skin adjacent and in contact with a second face of the foam core, opposite the first face. The first and second skins each terminate in an elongated C-shaped edge.

A connector for joining adjacent panels includes an elongated T-shaped channel for receiving C-shaped elongated edges of the first skin of adjacent panels, an elongated I-shaped channel for receiving C-shaped elongated edges of the second skin of adjacent panels, and a sheet member joining the T-shaped channel and the I-shaped channel. Part of the foam core of adjacent panels abuts each side of the sheet member. The T-shaped channel and the I-shaped channel each include elongated lip portions for retaining the C-shaped elongated edges of the first skin and second skin. Alternatively both channels may be T-shaped or both channels may be I-shaped. The panels are in snapping or sliding engagement with the connector. A system of the invention is typically used for roof and/or wall panels.

An object of the invention is to provide an improved insulating panel system.

A further object of the invention is to provide an improved insulating panel system which is readily assembled and disassembled.

Another object of the invention is to provide an insulating panel.

Yet another object of the invention is to provide a connecting member for panels of the invention.

BRIEF DESCRIPTION OF THE DRAWINGS

FIG. 1 is a perspective view of an insulating panel system including panels and a connector, of the invention.

FIG. 2 is an end elevational view of the insulating panel system of FIG. 1.

DETAILED DESCRIPTION OF THE INVENTION

Figure 3:
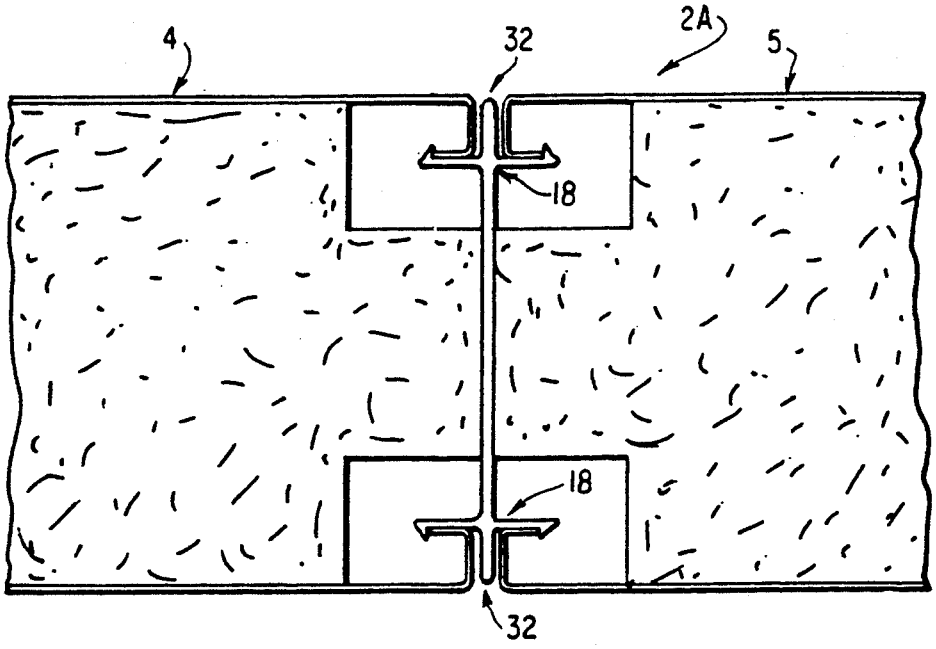
FIG. 3 is an end elevational view of an insulating panel system using another connector.

Insulating panels of the invention are typically used for roof panels and/or wall panels. The panels may also be used for other appropriate purposes, if required. Panels and connectors of the invention are particularly useful when a room or porch is added to an existing building, since construction using the panel system is simple, rapid and economical. A panel of the invention includes a foam core, such as a polystyrene core, laminated on one or both sides to drywall, wall paneling, aluminum or other sheet metal, or a combination of these or other sheet materials. Since about 90% of the foam core mass is closed air cells, the foam core cannot absorb moisture and will not be deteriorated by moisture.

The panels are generally engaged in position by snapping or sliding into extruded plastic connectors. This connecting operation can be accomplished very simply and rapidly, even when standing on scaffolding, since the panels and connectors are lightweight.

Panels of the invention are strong, lightweight and complete with interior and exterior wall finishes. The panels can be installed rapidly using connectors of the invention, and are maintenance free. The panels are soundproof and may be custom designed from about 4 ft. to 24 ft. in length.

The foam core, in non-limiting example, may be of expanded polystyrene foam between 1 inch and 8 inches in thickness and may be laminated to a variety of inner and outer wall panels. In non-limiting examples, the wall panels which form inner and outer skins for the foam core may be drywall, wall paneling, aluminum sheet or a combination, depending on use of the panels. When the panels are finished with $\frac{5}{8}$ inch gypsum on both sides, the panels are fire resistance rated for one hour. For roofing use, an insulating panel may have stucco embossed aluminum inner and outer panels on each side of a 3 to 4 inch foam core. Such a roofing panel, bonded appropriately, will withstand temperatures up to about 260 degrees F. and have an insulation "R factor" greater than 15. The "R factor" expresses the ability of the product to resist heat transmission.

With reference to the Figures, in which like numerals represent like parts, FIGS. 1 to 4 illustrate insulating panel system 2 which includes insulating panels 4 and 5 joined by a connector 6. The portion shown is typical of a multipanel system using panels of the invention. Foam cores 8 and 9 may include closed cell polystyrene foam which has a thermal resistance or "R factor" of about 4.17 per inch at 40 degrees F. and 3.95 per inch at 75 degrees F. A typical finished panel of the invention, 3–4 inches thick, has an "R factor" of about 15.

Foam cores 8 and 9 are each laminated to first skin 10 on one side of the core and second skin 12 on the opposite side of the core. First skin 10 terminates in an elongated C-shaped edge 14 and second skin 12 terminates in an elongated C-shaped edge 16. Panels 4 and 5 snap or slide into engagement with connector 6 which receives and holds C-shaped edges 14 and 16. C-shaped edges 14 and 16 turn inwardly toward the foam core, and the foam core is cut out in the area of the C-shaped edges to facilitate snapping or sliding the panels together. The remainder of the foam core, not cut out, extends outward to abut the connector. End faces of the foam core are substantially coplanar with end faces 17 of the C-shaped edges of the first and second skins 10,12.

As shown in FIGS. 1 and 2, connector 6 includes a first channel 18 for receiving C-shaped edges 14 and a second channel 20 for receiving C-shaped edges 16. First channel 18 is preferably a T-shaped channel having lip portions 22 at each end of arms 24 which engage C-shaped edges 14 in connector 6. Second channel 20 is preferably an I-shaped channel having lip portions 26 at each end of arms 28 which engage C-shaped edges 16 in connector 6. Crosspiece 30 of I-shaped channel 20 is a substantially flat strip which covers over the joint between panels 4 and 5. On the opposite side, space 32, between the panels adjacent T-shaped channel 18, is filled with a bead of plaster or other appropriate sealing material.

T-shaped channel 18 and I-shaped channel 20 of connector 6 are joined by sheet member 34 which extends the length of the panels. The combined width of T-shaped channel 18, sheet member 34 and I-shaped channel 20 is approximately equal to the thickness of each of panels 4 and 5.

Figure 4:
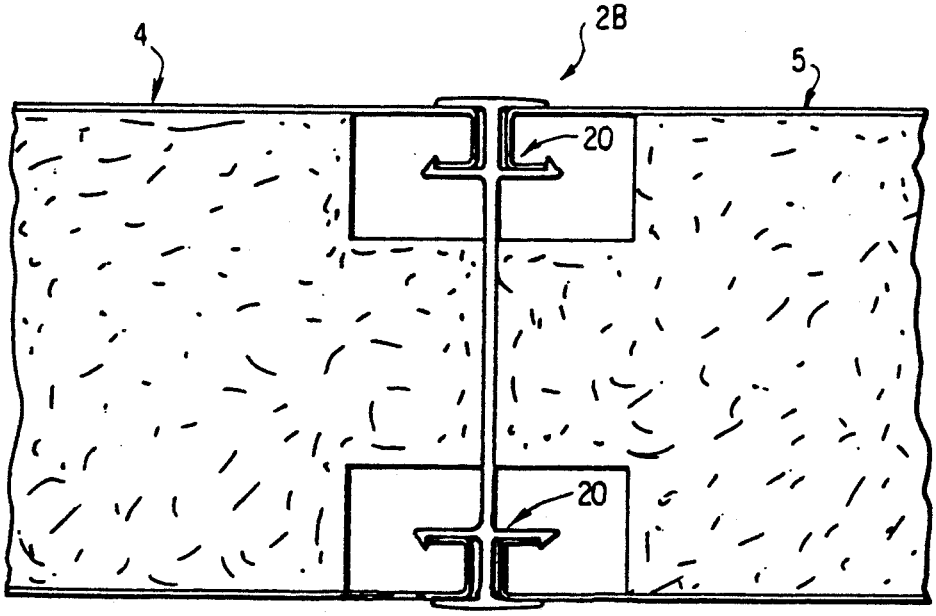
FIG. 4 is an end elevational view of an insulating panel system using yet another connector.

In alternative embodiments, shown in FIGS. 3 and 4, the connector terminates either in T-shaped channels or I-shaped channels on both sides of the panels. FIG. 3 illustrates T-shaped channels 18 at each end of a connector joining panels 4 and 5 of panel system 2A. FIG. 4 illustrates I-shaped channels 20 at each end of a connector joining panels 4 and 5 of panel system 2B. Other useful configurations of channel will be apparent to one skilled in the art.

Connector 6 is made of extruded plastic, metal or other material known in the art, and must be sufficiently resilient and/or flexible to allow the panels to snap into place within the channels of the connector.

Foam cores 8 and 9 are shaped with elongated cut-out portions adjacent each elongated C-shaped edge to facilitate snapping the panels to the connector. Cut-out portions 36, 38, 40 and 42 are each located adjacent portions of sheet member 34. Faces 44 and 46 of foam cores 8 and 9 are positioned substantially abutting each side of sheet member 34 when the insulating panel system of the invention is assembled. If faces 44 and 46 are substantially spaced from sheet member 34, insulating properties of the panel system are reduced since an air/moisture channel through the panel system is created.

When an insulated panel system of FIGS. 1 and 2 is used for roofing, crosspiece 30 is generally positioned on the outside of the roof and T-shaped end 18 is adjacent the ceiling of the area being roofed. Space 32, which may be a join in a ceiling of a room being roofed, is filled with a snap cleat, known in the art, or with plaster or other appropriate filler. When an insulated panel system of the invention is used for wall paneling, crosspiece 30 is generally positioned on the inside of the area being paneled. Space 32, on the cutside of the area being paneled, is filled with a snap cleat, known in the art, or with plaster or other appropriate sealing material. Using the panel of FIG. 3, space 32 on both sides of the panel is similarly filled.

Facing material for the panels is selected according to use, and may be drywall, metal sheet such as embossed aluminum sheet, wall paneling or other facing material known in the art. Other appropriate materials for making all parts of the insulating panel system described may be known to one skilled in the art.

In assembling the insulating panel system, the panels may be engaged with the connector by snapping the panels into place on each side of the sheet member of the connector. Alternatively, the system may be assembled by sliding the panels into the channels at each edge of the connector. Each C-shaped edge is engaged in place and held by a lip on an I-shaped channel or T-shaped channel of the connector. In a preferred embodiment, the connector is resilient extruded plastic which facilitates snapping the panels into place adjacent the connector with the C-shaped channels of the first and second skins engaging the channels of the connector.

While the invention has been described above with respect to certain embodiments thereof, it will be appreciated that variations and modifications may be made without departing from the spirit and scope of the invention.

What is claimed is:

1. An insulating panel system comprising:

panel means for insulating, said panel means comprising a skin adjacent and in contact with a first face of an insulating foam core and a second skin adjacent and in contact with a second face of said insulating foam core opposite said first face, said first skin terminating in an elongated C-shaped edge and said second skin terminating in an elongated C-shaped edge, wherein portions of said foam core are cut away around said elongated C-shaped edges of said first and second skins, and wherein a plurality of said panel means are joined in adjacent relationship to form said insulating panel system; and connecting means for joining said C-shaped elongated edges of said first skin and said second skin of each of panel means to be joined in adjacent relationship, said connecting means comprising first channel means for receiving said C-shaped elongated edges of said first skin of adjacent panel means to be joined, and a sheet member joining said first channel means and said second channel means, wherein at least one of said first and second channel means comprises lip means for retaining elongated edges of outer skins of panels to be joined, and wherein a portion of the foam core of each panel means substantially abuts said sheet member.

2. An insulating panel system according to claim 1 wherein said first channel means is T-shaped and said second channel means is I-shaped.

3. An insulating panel system according to claim 1 wherein said first and second channel means are T-shaped.

4. An insulating panel system according to claim 1 wherein said first and second channel means are I-shaped.

5. An insulating panel system according to claim 1 wherein said first and second channel means comprise arm portions terminating in elongated lip means for retaining said C-shaped elongated edges of said first skin and said second skin.

6. An insulating panel system according to claim 1 wherein said foam core comprises polystyrene.

7. An insulating panel system according to claim 1 wherein said connecting means comprises extruded plastic.

8. An insulating panel system according to claim 1 wherein said connecting means comprises metal.

9. An insulating panel system according to claim 1 wherein said first skin comprises metal sheet material.

10. An insulating panel system according to claim 1 wherein said first skin comprises drywall.

11. An insulating panel system according to claim 1 wherein said second skin comprises metal sheet material.

12. An insulating panel system according to claim 1 wherein said first skin and said second skin each comprise aluminum sheet material.

13. An insulating panel system according to claim 1 wherein said panel means is in snapping engagement with said connecting means.

14. An insulating panel system according to claim 1 wherein said panel means is in sliding engagement with said connecting means.

15. An insulating panel system comprising:

first and second panel means for insulating, each of said panel means comprising a first skin adjacent and in contact with a first face of an insulating polystyrene foam core and a second skin adjacent and in contact with a second face of said insulating polystyrene foam core opposite said first face, said first skin terminating in an elongated C-shaped edge and said second skin terminating in an elongated C-shaped edge, wherein said foam core is cut away around said C-shaped elongated edges of said first skin and said second skin; and extruded plastic connecting means for joining said C-shaped elongated edges of said first and second skins of said first and second panel means to be joined, said connecting means comprising first channel means for receiving said C-shaped elongated edges of said first skin of said first and second panel means to be joined and second channel means for receiving said C-shaped elongated edges of said second skin of said first and second panel means, wherein said first and second channel means comprise arm portions terminating in elongated lip means for retaining said C-shaped elongated edges of said first skin and said second skin, and a sheet member joining said first channel means and said second channel means, wherein a portion of the foam core of said first and second panel means substantially abuts each side 16. An insulating panel comprising a first skin adjacent and in contact with a first face of an insulating foam core and a second skin adjacent and in contact with a second face of said insulating foam core opposite said first face, said first skin terminating in an elongated C-shaped edge and said second skin terminating in an elongated C-shaped edge, wherein an end face of said foam core is substantially coplanar with end faces of said C-shaped edges of said first and second skins, and said foam core is cut away around said elongated C-shaped edges of said first and second skins.

17. A connector for joining insulating panels having a foam core positioned between a first skin and a second skin on opposite sides of the foam core, said connector comprising first channel means for receiving elongated edges of the first skin of panels to be joined together by the connector and second channel means for receiving elongated edges of the second skin of said panels, and a sheet member joining said first channel means and said second channel means wherein at least one of said first and second channel means comprises lip means for retaining elongated edges of outer skins of panels to be joined, and wherein a portion of the foam core of adjacent panels abuts each side of said sheet member.

18. A connector according to claim 17 wherein at least one of said first and second channel means is substantially T-shaped.

19. A connector according to claim 17 wherein at least one of said first and second channel means is substantially I-shaped.

* * * * *